United States Patent [19]

Wincze

[11] 4,383,573

[45] May 17, 1983

[54] ROTARY REGENERATIVE AIR HEATER

[75] Inventor: Steven P. Wincze, Windsor, Conn.

[73] Assignee: Combustion Engineering, Inc., Windsor, Conn.

[21] Appl. No.: 343,142

[22] Filed: Jan. 28, 1982

[51] Int. Cl.[3] ..... F28D 19/04

[52] U.S. Cl. ..... 165/7; 165/8

[58] Field of Search ..... 165/7, 8, 5

[56] References Cited

U.S. PATENT DOCUMENTS

| | | | |
|---|---|---|---|
| 2,549,583 | 4/1951 | Eckersley | 165/5 |
| 2,883,160 | 4/1959 | Palmiter et al. | 165/7 |
| 3,799,241 | 3/1974 | Schluter et al. | 165/5 X |
| 3,874,442 | 4/1975 | Johnsson | 165/5 X |

*Primary Examiner*—Albert W. Davis, Jr.
*Attorney, Agent, or Firm*—William W. Habelt

[57] ABSTRACT

A rotary regenerative air heater assemby (20) wherein a gas damper (18) is mounted directly atop the gas inlet (41) to air heater rotor (30). In order to permit removal of heat transfer material element baskets (40), an access opening (52) is provided in the gas damper (18). Track means (60) for supporting and guiding a hoist (62) are disposed in the duct (26) above the access opening (52) in the gas damper. Element baskets (40) may be lifted from the rotor (30) by the hoist (62) upwardly through the access opening (52) in the gas damper for removal and replacement.

2 Claims, 3 Drawing Figures

ROTARY REGENERATIVE AIR HEATER

BACKGROUND OF THE INVENTION

The present invention relates generally to rotary regenerative air heaters, and more particularly, to an improved arrangement for accessing and removing element baskets from a rotary regenerative air heater.

A rotary regenerative air heater essentially comprises a rotor that carries heat transfer material that is alternately rotated first into a hot gas stream to absorb heat therefrom and then into an airstream to impart heat thereto. The heat exchange material carried by the rotor generally comprises a mass of heat absorbent plates. These plates are assembled in an orderly array and positioned in an element basket that firmly holds the plate in a predetermined space relationship in order that they may be easily handled and arranged in the rotor of the air heater.

Hot gases, usually generated by combusting a fossil fuel in a furnace, pass from the furnace through a damper and a toggle duct into the air heater and thence over the heat absorbent material contained therein. The toggle duct is disposed between the air heater and the furnace exit gas duct and serves to isolate forces generated by furnace expansion so that the air heater is not subjected to and damaged by those forces.

As the gas flows through the heat absorbent material, the heat absorbent material may become loosened in the element baskets, corroded, and covered with particulate material in the gases. Therefore, it is necessary that the element baskets be periodically removed and replaced. Heretofore, it has necessary to provide a significant amount of head room above the air heater between the air heater gas inlet and the gas damper and toggle duct in order that a trolley mechanism may be installed to permit element basket to be lifted from the air heater and removed. Typically, five to six feet of head space was required on prior art air heaters.

SUMMARY OF THE INVENTION

The present invention contemplates an air heater design wherein the need for head room between the air heater gas inlet and the gas dampers is eliminated.

According to the present invention, the gas damper is disposed across and mounted atop the gas inlet at the top of the air heater rotor housing. The gas damper is laterally sectioned into two halves with a capped opening separating the two halves for providing access to the heat absorbent material within the rotor. A toggle duct interconnects the furnace gas duct with the gas damper mounted atop the gas inlet. Track means are disposed within a toggle duct above the access opening in the damper for supporting and guiding a hoist. An access opening is also provided into the wall of the toggle duct adjacent the track. When it is necessary to remove an element basket, the opening in the sectioned damper is uncapped and the element baskets are lifted from the rotor by the hoist through the opening in the damper to a position adjacent the access opening in the toggle duct wall and removed therethrough. New element baskets can then be attached to the hoist, passed over the access opening in the damper and lowered into position in the rotor.

BRIEF DESCRIPTION OF THE DRAWING

The present invention can be best understood when reviewed in conjunction with the accompanying drawing in which.

DESCRIPTION OF THE PREFERRED EMBODIMENT

Figure 1:
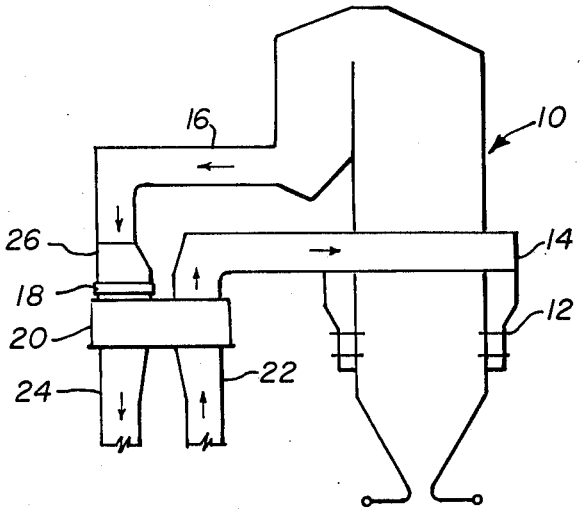
FIG. 1 is a side view of a fossil fuel-fired furnace incorporating a rotary regenerative air heater.

Referring now to the drawing, and more particularly to FIG. 1 thereof, there is depicted therein a furnace 10 wherein a fossil fuel, introduced through burners 12, is burned. Combustion air is introduced to the furnace 10 through air supply duct 14. Hot combustion gases formed in the furnace 10 upon combustion of fuel therein, pass from the furnace 10 through duct 16 and gas damper 18 to air preheater 20. Combustion air, typically at ambient temperature, is supplied to the air heater 20 through inlet duct 22. The air passing through the air heater 20 is passed in heat exchange relationship with the hot gases and thereby preheated prior to introduction into the furnace. After giving up heat in air heater 20, the combustion gases are discharged to the atmosphere through duct 24. A toggle duct 26 is disposed between the furnace gas duct 16 and the air heater 20 so as to isolate any forces generated by furnace expansion so that the air heater 20 is not subjected to and demaged by such forces.

Figure 2:
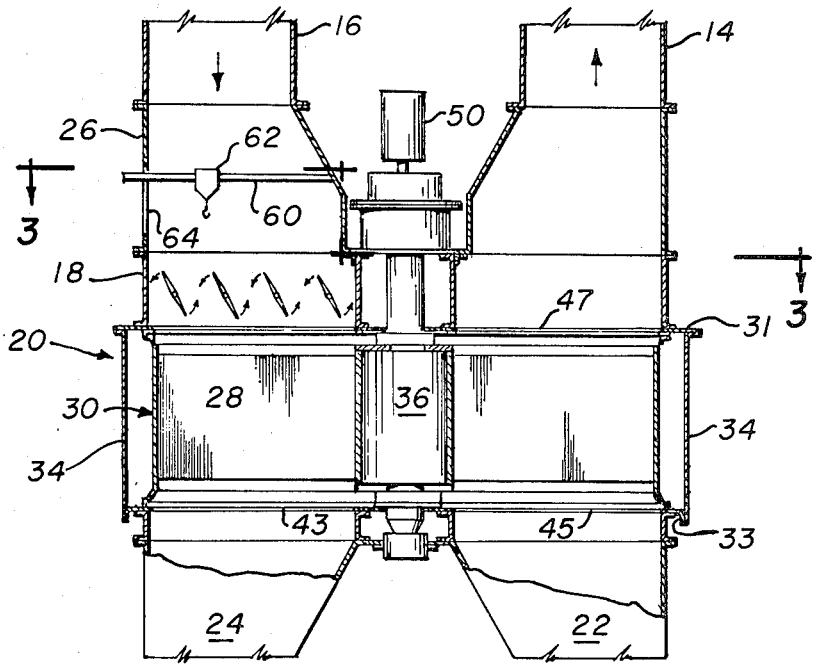
FIG. 2 is a sectional view of a rotary regenerative air heater designed in accordance with the present invention.
Figure 3:
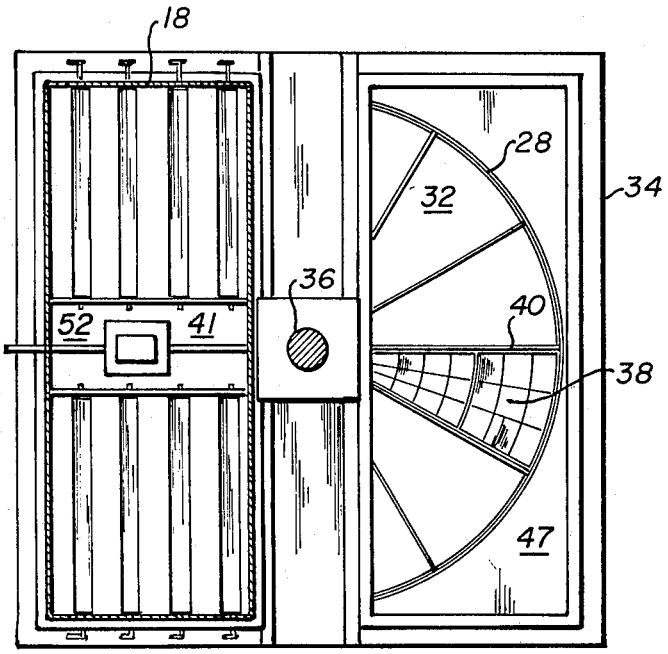
FIG. 3 is a top plan view of a rotary regenerative air heater taken along line 3—3 of FIG. 2.

Referring now to FIGS. 2 and 3, there is depicted therein a rotary regenerative air heater assembly 20 designed in accordance with the present invention. The air heater assembly 20 comprises air heater per se, a gas damper, a toggle duct, and tracking means disposed within the toggle duct for supporting and guiding a hoist.

The air heater rotor 30 comprises a shell 28 formed of a plurality of sector-shaped compartments 32 extending radially from a vertical rotor post 36. The rotor 30 is enclosed in a housing 34 which is provided with end plates 31 and 33 that are formed with circumferentially spaced openings 41, 43, 45 and 47 which serve as the gas inlet, the gas outlet, the air inlet, and the air outlet, respectively, to the air heater for directing the flow of streams of heating gas and air to be heated to and through the rotor 30.

Conventionally, the rotor 30 carries a mass of heat absorbent material 38 that is contacted by the stream of hot gases leaving the furnace 10 through exit gas duct 16 and entering the air heater housing 34 through inlet opening 41 and exhausted therefrom though outlet opening 43 after having traversed the heat absorbent material 38 disposed within the rotor 30. The heat absorbent material 38 is heated by contact with the hot gases traversing the rotor 30. Ambient air to be heated enters the air heater housing 34 through inlet opening 45 and is exhausted therefrom through outlet opening 47 after having traversed the heated heat absorbent material disposed within the rotor. While the heating gas and air are traversing their respective passages through the air heater housing 34, the rotor 30 is being rotated about rotor post 30 by drive means 50, such as a motor, so that the heat absorbent material contained therein is alternately exposed to the heating gas and the air to be heated.

The heat exchange material carried by the rotor 30 comprises a mass of heat absorbent plates 38 assembled in an orderly array in spaced relationship and positioned in element baskets 40 that firmly hold the plates in their predetermined space relationship in order that they may be easily handled as an integral element when arranged in the rotor 30 of the air heater. The heating gas and the air to be heated flow over the plates 38 through the flow passageways between the spaced plates as the gas and air traverse the rotor 30. Each element basket 40 is positioned within a sector 32 of the rotor 30. Each sector 32 contains multiple layers of element baskets 40 with multiple element baskets 40 in each layer. Typically, an element basket 40 may be as much as 3 feet wide, 3 feet deep, and almost 4 feet high.

After a set of element baskets has been in service for a period of time, there is a tendency for the heat absorbent plates 38 to corrode and erode away due to their being in continuous contact with the hot gases which are often laden with dust and corrosive compounds. Additionally, there is a tendency for the individual plates to become loose within a basket assembly during periodic cleaning by high-pressure air blast. Accordingly, it is necessary that the element baskets be accessible for removal and replacement periodically in order to maintain heat transfer efficiency within the air heater.

Heretofore, it has been necessary to provide at least 5 to 6 feet of head space immediately above the gas inlet 41 or the air outlet 47 through the air heating housing 34 so that a hoist system may be disposed therein for lifting the element baskets 40 from the rotor 30 when replacement is necessary. According to the present invention, this undesirable head space is eliminated and the gas damper 18 is disposed across and mounted directly atop the gas inlet 41 at the top of the air heating housing 34. The gas damper 18 is provided with a capped opening therein for providing access to the heat absorbent material within the rotor 30. Preferably, the gas damper 18 is split laterally to provide an elongated central cavity extending radially across and above the gas inlet 41 to the air heating housing 34 as best shown in FIG. 3.

The toggle duct 26 for isolating the air heater from furnace forces, is disposed between the furnace exit duct 16 and the gas damper 18 mounted atop the gas inlet 41 to the air heater housing 34. Track means 60 are disposed within the toggle duct 26 above the access opening 52 in the gas damper 18. The track means 60 provides means for supporting and guiding a hoist 62 above the access opening 52 in the gas damper 18. Additionally, an access opening 64 is provided in the wall of the toggle duct 26 adjacent the track means 60 so that element baskets lifted by the hoist may be removed therethrough.

To remove an element basket 40, the rotor 30 is rotated about rotor post 36 until the element basket to be removed lies directly below the gas inlet 41 to the air heater housing 34. The access opening 52 in the gas damper 18 is uncapped and the hoist 62 is guided along track means 60 until it lies directly above the element basket 40 to be removed. The track means 60 extends radially across the rotor 30 so that it may be selectively positioned at any location across the radial expanse of the rotor 30. Once correctly positioned, the hoist 62 is activated to hook the element basket 40 to be removed. Once properly hooked, the element basket 40 is lifted by the hoist 62 upwardly out of the rotor 30 through the gas inlet 41 in air heater housing 34 and through the uncapped access opening 52 in the gas damper 18 to a position adjacent the access opening 64 in the wall of the toggle duct 26. The hoist 62 is then moved to a position adjacent the wall of the toggle duct 26 and the element basket 40 removed through the access opening 64 and replaced with a new element basket. The new element basket is properly positioned within its sector 32 of the rotor 30 by simply reversing the aforedescribed steps.

While the present invention has been described and illustrated in the drawing with reference to an embodiment wherein a gas damper is disposed above the gas inlet to the air heater and the element baskets are removed through an access opening in the gas damper, it should be considered within the scope of this invention to provide an access opening in an air damper for removal of the element baskets therethrough if an air damper is mounted atop the air outlet to the air heater and it is preferable to remove the basket through the air side rather than the gas side of the air heater. Therefore, it is intended by the appended claims to cover the modification just eluded to, as well as all other modifications, which fall within the true scope and spirit of our invention as described in the appended claims.

I claim:

1. A rotary regenerative air heater assembly for receiving hot flue gas from a furnace and transferring heat therefrom to air being supplied to the furnace comprising: a vertical rotor post; a rotor disposed the rotor post and formed of a plurality of sector shaped compartments extending radially from the rotor post; a plurality of element baskets carrying heat absorbent material disposed within the rotor; a stationary housing surrounding the rotor and having inlet and outlet openings at both ends thereof for directing separated flows of air and gas through the heat absorbent material; means for rotating the rotor so as to align the heat absorbent material alternately with the heating gas and the air to be heated; damper means disposed across and mounted atop the gas inlet at the top of the housing and having opening therein for providing access to the heat absorbent material with the rotor; a toggle duct inter-connecting the furnace with the damper means mounted atop the gas inlet; track means disposed within the toggle duct above the access opening in the damper means for supporting and guiding a hoist; and an access opening in the wall of the toggle duct adjacent the track means through which a hoist may be mounted upon the track means to lift element baskets from the rotor through the access opening in the gas damper to a position adjacent the access opening in the wall of the toggle duct for removal of the element basket therethrough.

2. A rotary regenerative air heater assembly as recited in claim 1 wherein the damper means is divided laterally into two sections separated by a central access opening therein extending above and radially across the width of the gas inlet opening in the air heater housing.

* * * * *